US006837392B2

(12) United States Patent
Laurent

(10) Patent No.: US 6,837,392 B2
(45) Date of Patent: Jan. 4, 2005

(54) RESEALING ARRANGEMENT WITH ANTI-ROTATION AND OTHER FEATURES

(76) Inventor: Hervé J. Laurent, 40 rue de Saintonge, 75003 Paris (FR)

( * ) Notice: Subject to any disclaimer, the term of this patent is extended or adjusted under 35 U.S.C. 154(b) by 0 days.

(21) Appl. No.: 10/225,901

(22) Filed: Aug. 22, 2002

(65) Prior Publication Data

US 2004/0035869 A1 Feb. 26, 2004

(51) Int. Cl.[7] ..... B65D 51/18
(52) U.S. Cl. ..... 220/259.3; 215/330
(58) Field of Search ..... 220/259.3, 288, 220/906, 739, 711, 713, 737; 215/330, 217–219; 222/192, 570

(56) References Cited

U.S. PATENT DOCUMENTS 4,579,257 A * 4/1986 Brandlein ..... 222/192
5,176,278 A * 1/1993 Quarberg ..... 220/320
5,467,888 A * 11/1995 Brandstrom et al. ..... 220/319
5,947,324 A * 9/1999 Palinchak ..... 220/713
6,155,452 A * 12/2000 Laurent ..... 220/739
6,575,324 B1 * 6/2003 Hamer ..... 220/258.5
2003/0178433 A1 * 9/2003 Adams

* cited by examiner

*Primary Examiner*—Lien Ngo
(74) *Attorney, Agent, or Firm*—Notaro & Michalos P.C.

(57) ABSTRACT

A resealing arrangement for a beverage container having a top with an aperture to discharge beverage, includes a main cap over the container top, having a threaded neck with an opening for discharging the beverage. A seal hermetically connected to the main cap, extends against the container to hermetically seal with the container. A locking sleeve is connected to the main cap for fixing the main cap to the beverage container with sufficient force to resist pressure from, and to maintain pressure in the beverage container. A secondary cap is threaded to the neck and an anti-rotation projection extending from the main cap can be used to resist co-rotation of the main and secondary caps.

12 Claims, 4 Drawing Sheets

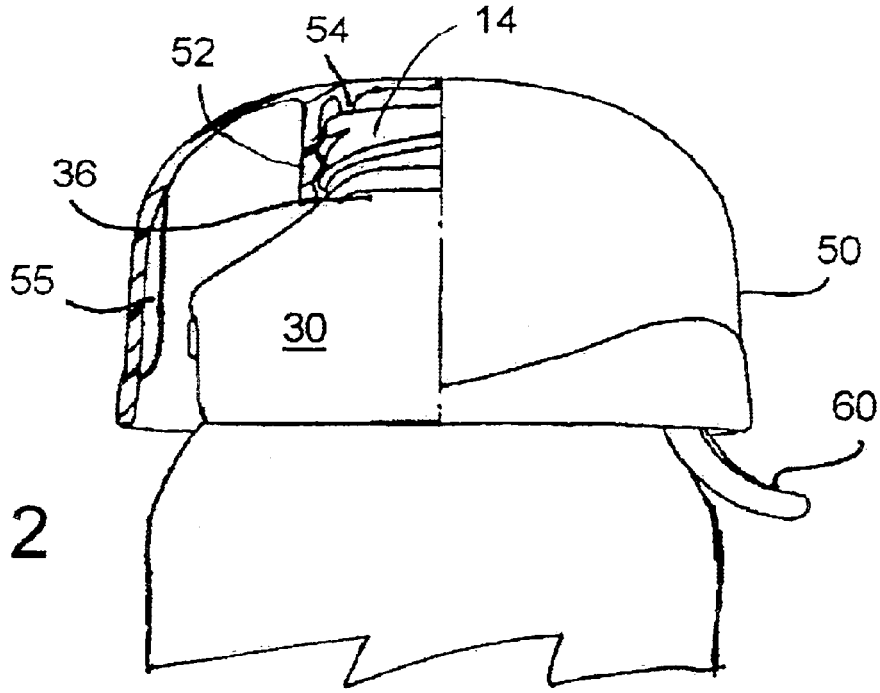
FIG. 2
FIG. 3
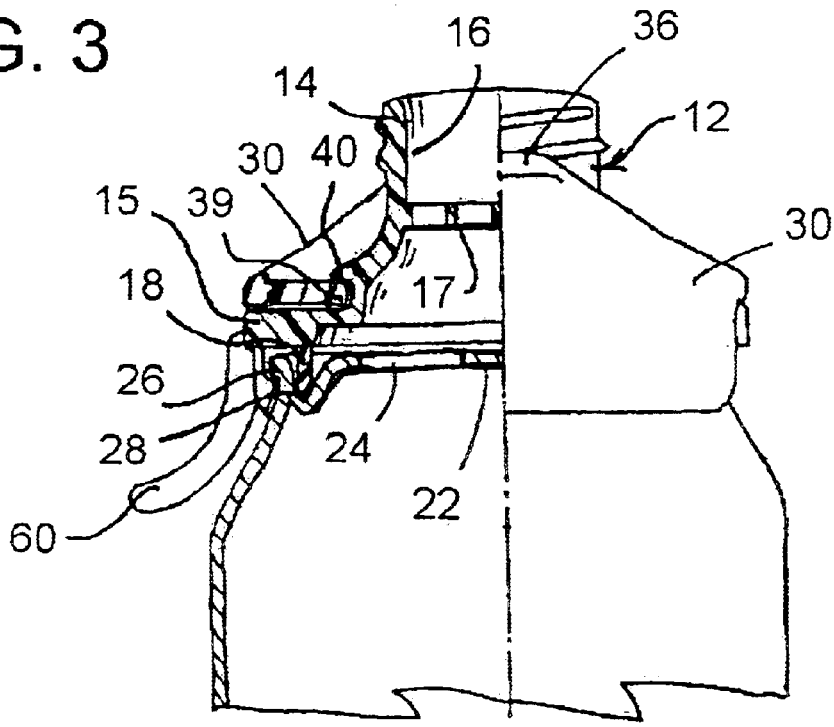

RESEALING ARRANGEMENT WITH ANTI-ROTATION AND OTHER FEATURES

FIELD AND BACKGROUND OF THE INVENTION

The present invention relates generally to the field of beverage containers, and in particular to a new and useful arrangement for resealing a beverage container such as a carbonated beverage can.

Aluminum cans have been used to contain carbonated beverages, pressurized soda, beer or other pressurized beverages as well as non-carbonated drinks for many years.

Initially, the cans were opened using a can opener which cut a triangular hole into the upper surface of the can near its outer rim or bead. Later, tab openers were developed which included a tab connected to a portion of the can cover, surrounded by a weakening. The tab was pulled to dislodge the portion, thus exposing an opening. Tabs were discarded and posed a litter problem. The technology developed further to produce attached tabs which were used as levers to rupture a peripheral weakening and push a section of the can top down into the can. The tab ripped away a portion of the can top and permanently attached itself to the can so that the can with its tab and top could be discarded or recycled as a unit.

Although such cans are normally thought of as single-use products, various devices have been developed to re-close the can to allow it to be re-used at some future time. These devices generally failed to reseal the can and preserve carbonization. Some merely re-close the can opening to avoid contamination.

U.S. Pat. No. 6,155,452 issued to the present inventor, is incorporated here by reference, and discloses an arrangement for resealing carbonated beverage containers having a top with an aperture that can be opened by a secondary cap to discharge the beverage, and a bead with an inner surface around the top. The arrangement has a main cap for engagement over the beverage container top, for covering the beverage container top, a seal member connected hermetically to the main cap and extending toward the beverage container top and a locking mechanism connected to the main cap for fixing the main cap to the beverage can with sufficient force to resist pressure from, and to maintain pressure in the beverage container. The seal member has an annular pressure sealing portion adapted to engage against, and hermetical seal with the inner surface of the beverage container bead.

Although the arrangement disclosed in the inventor's U.S. Pat. No. 6,155,452 effectively reseals the beverage container, when the secondary cap is tightly screwed onto the main cap, or unscrewed from the main cap, the entire arrangement tends to rotate on top of the beverage container.

The geometry for latching and unlatching the main cap to the beverage container top is also complex as is the mechanism for connecting the two part of the main cap to each other.

The present invention improves various aspects of the arrangement disclosed in U.S. Pat. No. 6,155,452

SUMMARY OF THE INVENTION

It is an object of the present invention to provide a resealing arrangement for a beverage container having a top with an aperture to discharge beverage, that includes a main cap for engagement over and for covering the container top.

The main cap has a threaded neck with an opening for discharging the beverage. A seal member is hermetically connected to the main cap and extends toward the beverage container when the main cap is over the beverage container, the seal member having a free flexible pressure sealing portion adapted to engage against and hermetically seal with the beverage container, for resealing the aperture, the pressure sealing portion having an outer surface which, with the main cap engaged over the beverage container, lies at least partially against the container, and an exposed inner surface so that pressure from the beverage container acts on the inner surface of the pressure sealing portion and presses the outer surface of the sealing portion against the container to increase the hermetic sealing effect. Locking means, preferably in the form of an at least partly flexible locking sleeve is connected to the main cap for fixing the main cap to the beverage container with sufficient force to resist pressure from, and to maintain pressure in the beverage container. A secondary cap is threaded to the neck and anti-rotation means, preferably in the form of an anti-rotation projection, extend from the main cap and can be used to resist co-rotation of the main and secondary caps for allowing easier threading of the secondary cap, onto and off the main cap.

Another object of the invention is to provide such a resealing arrangement which has a unique and simple engagement of the sleeve to the main cap and a domed secondary cap for covering the main cap and the sleeve.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 2 is a side sectional view, partly in elevation of the arrangement engaged to a beverage container;

FIG. 3 is an opposite side sectional view similar to FIG. 2 of the arrangement;

DESCRIPTION OF THE PREFERRED EMBODIMENTS

Figure 1:
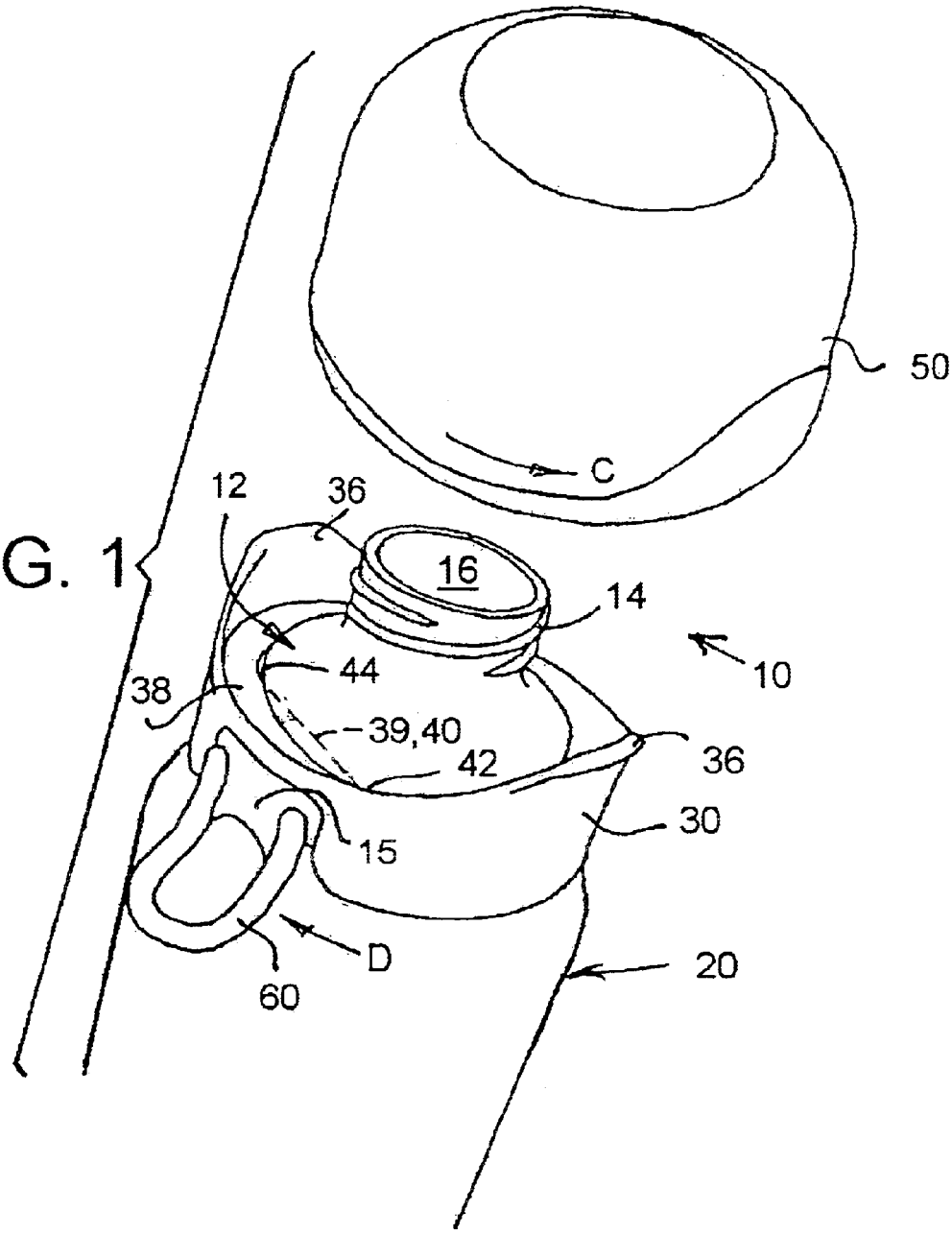
FIG. 1 is a perspective view of the arrangement for resealing a beverage container embodying the invention.

Referring now to the drawings, in which the same reference numerals are used to refer to the same or similar elements, FIG. 1 illustrates an arrangement generally designated 10 for resealing a beverage container such as a soda or beer can 20. As shown in FIG. 3, the beverage container has a top 22 with an aperture 24 that can be opened in a known fashion to discharge the beverage. The beverage container includes an outer bead 26 and a groove 28 inside and adjacent the bead.

The arrangement 10 comprises a main cap generally designated 12, for engagement over the beverage container top for covering the top. The main cap 12 has a threaded neck 14 with an opening 16 therethrough for discharging beverage from the beverage container 20. The main cap 12 is molded of appropriate plastic material and includes a molded-in grate 17 across the opening 16 for blocking particle or insects from passing into can 20 through the opening.

An annular seal member 18, made of very resilient elastomeric material, is hermetically connected to the main cap 12 and extends down toward the beverage container top 22. The seal member 18 has a free end that extends at least partly into the groove 28 to engage against and hermetically seal with the beverage container, for resealing the aperture 24.

As fully disclosed in the inventor's U.S. Pat. No. 6,155,452, the free end of the sealing member forms a flexible, annular pressure sealing portion having an outer surface which, with the main cap engaged over the beverage container, lies at least partially against the inner surface of the container bead 26. This pressure sealing portion has an exposed inner surface directly opposite the outer surface so that pressure from the beverage container acts on the inner surface of the pressure sealing portion and presses the outer surface of the sealing portion against the inner surface of the container bead to increase the hermetic sealing effect. In this way, increased pressure from the can 20 actually increases the sealing effect rather than reducing it. This sealing effect, however, also relies on a positive locking of the arrangement to the can.

To this end, the arrangement includes a locking mechanism connected to the main cap for removably fixing the main cap to the beverage container with sufficient force to resist pressure from, and to maintain pressure in the beverage container.

Figure 4:
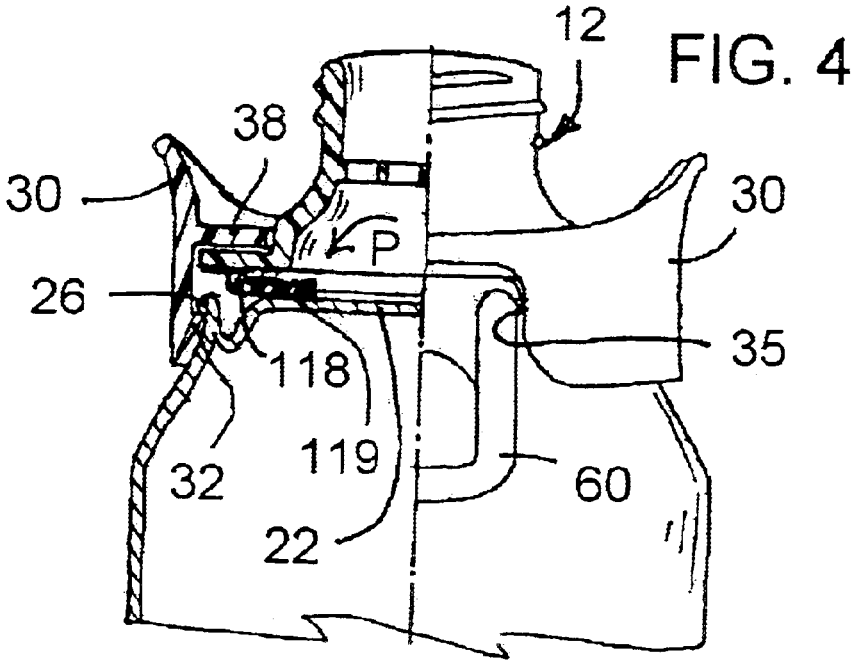
FIG. 4 is a front sectional view, partly in elevation of the arrangement engaged to a beverage container and with an alternate construction for the sealing member.

The preferred form of the locking mechanism is an at least partly flexible plastic sleeve 30 engaged around the main cap 12, the sleeve having a pair of opposite, lower, inwardly active and arcuate hooks 32 for engaging under the outer bead 26 of the beverage container 20 as shown in FIG. 4. The hooks positively hold the main cap to the beverage container. The sleeve 30 also has a pair of small dimension portions 34 intermediate the opposite hooks 32 which are bendable to allow spreading of the opposite hooks to disengage from the bead as shown in FIG. 5.

Figure 5:
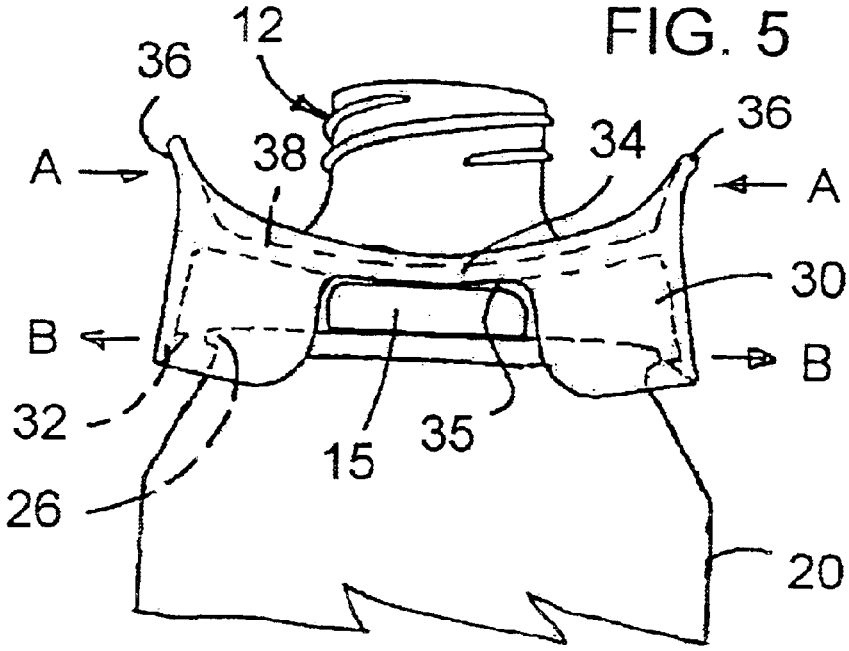
FIG. 5 is a rear elevational view of the arrangement as it is disengaged from the container.

The sleeve 30 has an upward enlargement 36 over each arcuate hook 32 for being pressed together in the direction of arrows A in FIG. 5, e.g. by the fingers of a user of the arrangement, to bend the pair of small dimension portions 34 and thus spread the opposite lower hooks 32 in the direction of arrows B in FIG. 5, to disengage the arrangement from the bead 26.

The sleeve 30 includes a horizontal ring 38 extending radially inwardly toward the main cap 12. The main cap 12 includes a pair of opposite grooves 40 below neck 14 (see FIGS. 1 and 3) each for receiving a retaining portion 39 of the ring 38 to retain the sleeve 30 to the main cap 12. Retaining portions 39 are smaller diameter parts of a round hole in the ring 38 for receiving the main cap 12 and having an otherwise large diameter. The cap 12 and the sleeve 30, when assembled, have a functional play allowing the sleeve to freely flex to a certain point.

The sleeve portions 34 and ring 38 bend to allow the hooks 32 to spread while the retaining portions 39 of the ring in the opposite grooves 40 limit the amount of bending at point 42 and 44, where the ring 38 emerges from the grooves 40 (see FIG. 1). The vertical play between the two parts at rest is critical (about 1 mm in the preferred embodiment) since it limits the flexing of the sleeve only to what is necessary to engage and disengage the devise on and from the can, thus preventing overstressing of the plastic.

The arrangement includes a secondary cap 50 with an inner neck 52 as shown in FIG. 2, that is threadably engaged to the threaded neck 14 of the main cap 12 for closing the opening 16 through the main cap with sufficient force to resist pressure from, and to maintain pressure in the beverage container 20. An inner annular ridge 54 tightly engages into opening 16 to help seal the opening further. Three equally and circumferentially spaced ribs 55 are formed on the inside vertical surface of the dome-shaped secondary cap 50. They each have inner edges that extend parallel to the central axis of the arrangement, that is exactly vertically and compensate for the slight outward taper of about 3 degrees of the side wall of the cap 50. The three (or more) ribs 55 have two functions. They permit sliding of the secondary cap 50 in a centered fashion, onto the bottom of the can (a position not shown in the drawings). The cap 50 thus acts like a coaster for the can, and also avoids losing the cap. The cap 50, in this lower upside-down position, acts to collect condensation water from the can to protect any surface the can is placed on. The condensation water flows into cap 50 because of the annular space between the can and the inside surface of the cap, formed by the ribs 55. So that the cap 50 can act like a coaster for the beverage container, the secondary cap 50 is dome shaped but with a top that is at least partly flat or slightly concave as shown in FIG. 2.

Anti-rotation means, e.g. in the form of a loop or tong 60, are defined on the main cap 12 for engagement, e.g. by the finger or thumb of a user which is held against one side of the loop, to resist co-rotation of the main cap and secondary cap when the secondary cap is threaded onto or off the threaded neck 14. Arrow C in FIG. 1 illustrates the rotation of the secondary cap 50 to remove it from the main cap 12, for example, while arrow D is the counter-force applied to the main cap 12 via loop 60. The anti-rotation means allows the cap 50 to be rightly threaded onto and thereafter removed from the cap 12, without causing undesired rotation of the main cap as well.

Figure 6:
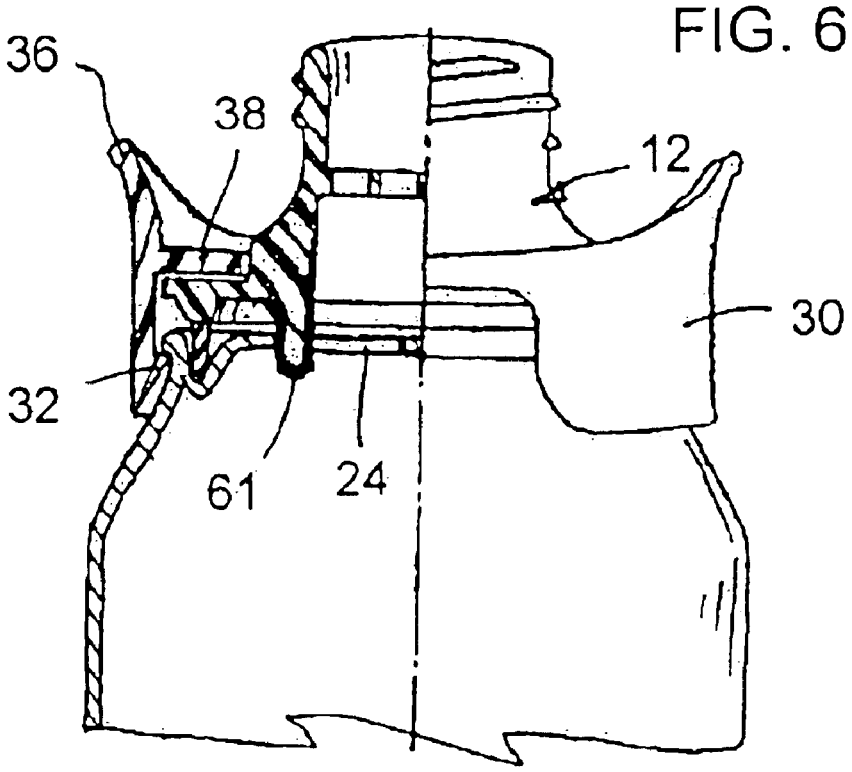
FIG. 6 is a view similar to FIG. 4, of another embodiment of the invention.

The loop 60 can be replaced by any anti-rotation projection extending from the main cap. In the embodiment of FIG. 6, the anti-rotation projection is a structure 61 extending from the bottom of the main cap 12, and adapted to extend into the aperture 24 of the beverage container 20 for resisting co-rotation of the main and secondary caps 12, 50.

The anti-rotation means of FIGS. 1–5 comprises an anti-rotation projection extending outwardly from the main cap 12 and beyond the secondary cap 50 for engagement by the user to hold the main cap against rotation.

The loop 60 fixed to, and preferably molded as one piece with the main cap, can also function to hang the beverage container from the loop, using, e.g. a latch or hook. The secure engagement provided by the locking means of the present invention allows the weight of the beverage container to be supported, e.g. to hang it from the users belt or back-pack, or to hang it at a point of purchase. The external anti-rotation projection 60 of FIGS. 1–5, unlike the embodiment of FIG. 6, also allows the beverage container aperture 24 to remain closed for storing the soda or beer can closed, using the arrangement of the invention, before it is opened. This also allows engagement of the invention onto a can that has not been opened which permits, for instance, carrying the non-opened can as previously described.

The loop 60 extends downwardly from the main and secondary caps and along a side of the beverage contain 20.

In this position the loop can be easily engages by the user's thumb while that hand holds the can and the user uses his or her other hand to screw the secondary cap 50 on, or un-screw it from the main cap 12.

The secondary cap 50 is dome shaped and extends over the main cap and the locking means for sanitary and esthetic reasons.

The small dimension portions 34 of the sleeve 30 that help facilitate the bending of the sleeve shown in FIG. 5, have lower recesses 35 between the opposite hooks 32. The main cap 12 has a pair side projections 15 shaped like, and extending into the lower recesses 35. The loop 60 extends down from one of these projections 15, on one side of the arrangement. This helps prevents any co-rotation between the main cap 12 and the locking sleeve 30 while still allowing some small play between these parts, and more importantly, allows the bending action of FIG. 5 for unlocking the main cap from the can 20.

FIG. 4 also illustrates an embodiment of the invention with a flexible seal member 118 that is hermetically connected to the main cap 12 and which extends down toward the container top. Member 118 has a free pressure sealing portion 119 which presses down onto the container top 22. This pressing action is actually increased by pressure leaving the container opening and illustrated by arrow P. This pressure pushes the seal more firmly against the container top.

The seal can be formed in other ways as well, for example, as disclosed in the inventor's U.S. Pat. No. 6,155,452.

Although one anti-rotation member such as a loop or projection is used in the illustrated embodiments, two or more such structures can be used according to the present invention.

While specific embodiments of the invention have been shown and described in detail to illustrate the application of the principles of the invention, it will be understood that the invention may be embodied otherwise without departing from such principles.

What is claimed is:

1. An arrangement for resealing a beverage container having a top with an aperture that can be opened to discharge the beverage and an outer bead around the top, the arrangement comprising:

a main cap for engagement over the beverage container top for covering the beverage container top, the main cap having a threaded neck with an opening therethrough for discharging beverage from the beverage container;

a seal member hermetically connected to the main cap and extending toward the beverage container when the main cap is over the beverage container, the seal member having a free flexible pressure sealing portion adapted to engage against and hermetically seal with the beverage container, for resealing the aperture, the pressure sealing portion having an outer surface which, with the main cap engaged over the beverage container, lies at least partially against the container, and an exposed inner surface so that pressure from the beverage container acts on the inner surface of the pressure sealing portion and presses the outer surface of the sealing portion against the container to increase the hermetic sealing effect;

locking means connected to the main cap for removably fixing the main cap to the beverage container with sufficient force to resist pressure from, and to maintain pressure in the beverage container;

a secondary cap threadably engaged to the threaded neck of the main cap for closing the opening through the main cap with sufficient force to resist pressure from, and to maintain pressure in the beverage container, the secondary cap extending over and fully covering the main cap and locking means; and anti-rotation means extending from the main cap for engagement to resist co-rotation of the main and secondary caps when the secondary cap is threadably engaged onto and off the threaded neck, the anti-rotation means comprising an anti-rotation projection extending outwardly from the main cap end beyond the secondary cap for engagement by a user to hold the main cap against rotation.

2. The arrangement according to claim 1, wherein the anti-rotation projection comprises a loop fixed to the main cap for also functioning to hang the beverage container from the loop.

3. The arrangement according to claim 2, wherein the loop extends downwardly from the main and secondary cap and along a side of the beverage contain.

4. An arrangement for resealing a beverage container having a top with an aperture that can be opened to discharge the beverage and an outer bead around the top, the arrangement comprising:

a main cap for engagement over the beverage container top for covering the beverage container top, the main cap having a threaded neck with an opening therethrough for discharging beverage from the beverage container;

a seal member hermetically connected to the main cap and extending toward the beverage container when the main cap is over the beverage container, the seal member having a free flexible pressure sealing portion adapted to engage against and hermetically seal with the beverage container, for resealing the aperture, the pressure sealing portion having an outer surface which, with the main cap engaged over the beverage container, lies at least partially against the container, and an exposed inner surface so that pressure from the beverage container acts on the inner surface of the pressure sealing portion and presses the outer surface of the sealing portion against the container to increase the hermetic sealing effect;

locking means connected to the main cap for removably fixing the main cap to the beverage container with sufficient force to resist pressure from, and to maintain pressure in the beverage container;

a secondary cap threadably engaged to the threaded neck of the main cap for closing the opening through the main cap with sufficient force to resist pressure from, and to maintain pressure in the beverage container; and anti-rotation means defined on the main cap for engagement to resist co-rotation of the main and secondary caps when the secondary cap is threadably engaged onto and oil the threaded neck;

the locking means comprising a sleeve engaged around the main cap, the sleeve having a pair of opposite lower arcuate hooks for engaging under the bead of the beverage container to hold the main cap to the beverage container, the sleeve having a pair of upward extension above the hooks and a pair of small dimension portions with tower recesses between the opposite hooks which are bendable to allow spreading of the opposite hooks to disengage from the bead;

the main cap have a pair of side projections extending into the lower recesses, the anti-rotation means comprising an anti-rotation projection extending outwardly and downwardly from one of the side projection of the main cap, and beyond the secondary cap for engagement by a user to hold the main cap against rotation.

5. An arrangement for resealing a beverage container having a top with an aperture that can be opened to discharge the beverage and an outer bead around the top, the arrangement comprising:

a main cap for engagement over the beverage container top for covering the beverage container top, the main cap having a threaded neck with an opening therethrough for discharging beverage from the beverage container;

a seal member hermetically connected to the main cap and extending toward the beverage container when the main cap is over the beverage container, the seal member having a free flexible pressure sealing portion adapted to engage against and hermetically seal with the beverage container, for resealing the aperture, the pressure sealing portion having an outer surface which, with the main cap engaged over the beverage container, lies at least partially against the container, end an exposed inner surface so that pressure from the beverage container acts on the inner surface of the pressure sealing portion and presses the outer surface of the sealing portion against the container to increase the hermetic sealing effect;

locking means connected to the main cap for removably fixing the main cap to the beverage container with sufficient force to resist pressure from, and to maintain pressure in the beverage container, the locking means comprising a sleeve engaged around the main cap, the sleeve having a pair of opposite lower arcuate hooks for engaging under the bead of the beverage container to hold the main cap to the beverage container, the sleeve having a pair of upward extensions above the hooks end a pair of small dimension portions with lower recesses between the opposite hooks which are bendable to allow spreading of the opposite hooks to disengage from the bead, the main cap having a pair side projections extending into the lower recesses; end a secondary cap threadably engaged to the threaded neck of the main cap for closing the opening through the main cap with sufficient force to resist pressure from, and to maintain pressure in the beverage container.

6. The arrangement according to claim 5, wherein the sleeve includes a ring extending radially inwardly toward the main cap, the main cap including a pair of opposite grooves each for receiving a retaining portion of the ring to retain the sleeve to the main cap, ring bending to allow the hooks to spread while the retaining portions of the ring in the opposite grooves limiting the amount of bending.

7. The arrangement according to claim 5, wherein the secondary cap is dome shaped and extends over the main cap and the sleeve, the dome shape having a top that is at least partly flat and a plurality of inwardly extending ribs in the dome-shaped cap.

8. An arrangement for resealing a beverage container having a top with an aperture that can be opened to discharge the beverage and an outer bead around the top, the arrangement comprising:

a main cap for engagement over the beverage container top for covering the beverage container top, the main cap having a threaded neck with en opening therethrough for discharging beverage from the beverage container;

a seal member hermetically connected to the main cap and extending toward the beverage container when the main cap is over the beverage container, the seal member having a free flexible pressure sealing portion adapted to engage against and hermetically seal with the beverage container, for resealing the aperture, the pressure sealing portion having an outer surface which, with the main cap engaged over the beverage container, lies at least partially against the container, and an exposed inner surface so that pressure from the beverage container acts on the inner surface of the pressure sealing portion and presses the outer surface of the sealing portion against the container to increase the hermetic sealing effect;

locking means connected to the main cap for removably fixing the main cap to the beverage container with sufficient force to resist pressure from, and to maintain pressure in the beverage container, the locking means comprising a sleeve engaged around the main cap, the sleeve having a pair of opposite lower arcuate hooks for engaging under the bead of the beverage container to hold the main cap to the beverage container, the sleeve having a pair of upward extensions above the hooks and a pair of small dimension portions with lower recesses between the opposite hooks which are bendable to allow spreading of the opposite hooks to disengage from the bead;

a secondary cap threadably engaged to the threaded neck of the main cap for closing the opening through the main cap with sufficient force to resist pressure from, and to maintain pressure in the beverage container; and anti-rotation means defined on the main cap for engagement to resist co-rotation of the main end secondary caps when the secondary cap is threadably engaged onto and off the threaded neck, the anti-rotation means comprising an anti-rotation projection extending outwardly from the main cap and beyond the secondary cap for engagement by a user to hold the main cap against rotation.

9. The arrangement according to claim 8, wherein the anti-rotation projection comprises a loop fixed to the main cap for also functioning to hang the beverage container from the loop.

10. The arrangement according to claim 9, wherein the loop extends downwardly from the main and secondary cap and along a side of the beverage contain.

11. An arrangement for resealing a beverage container having a top with an aperture that can be opened to discharge the beverage and an outer bead around the top, the arrangement comprising:

a main cap for engagement over the beverage container top for covering the beverage container top, the main cap having a threaded neck with an opening therethrough for discharging beverage from the beverage container, a seal member hermetically connected to the main cap and extending toward the beverage container when the main cap is over the beverage container, the seal member having a free flexible pressure sealing portion adapted to engage against and hermetically seal with the beverage container, for resealing the aperture, the pressure sealing portion having an outer surface which, with the main cap engaged over the beverage container, lies at least partially against the container, and an exposed inner surface so that pressure from the beverage container acts on the inner surface of the pressure sealing portion and presses the outer surface of the sealing portion against the container to increase the hermetic sealing effect;

locking means connected to the main cap for removably fixing the main cap to the beverage container with sufficient force to resist pressure from, and to maintain pressure in the beverage container;

a secondary cap threadably engaged to the threaded neck of the main cap for closing the opening through the main cap with sufficient force to resist pressure from, and to maintain pressure in the beverage container; and anti-rotation means defined on the main cap for engagement to resist co-rotation of the main and secondary caps when the secondary cap is threadably engaged onto and off the threaded neck;

the anti-rotation means comprising an anti-rotation projection extending outwardly from the main cap and beyond the secondary cap for engagement by a user to hold the main cap against rotation, the anti-rotation projection comprising a loop fixed to the main cap for also functioning to hang the beverage container from the loop.

12. The arrangement according to claim 11, wherein the loop extends downwardly from the main and secondary cap and along a side of the beverage contain.

* * * * *